US005449471A

United States Patent [19]

Ozaki et al.

[11] Patent Number: 5,449,471

[45] Date of Patent: Sep. 12, 1995

[54] UREA GREASE COMPOSTITION

[75] Inventors: Takahiro Ozaki; Yasushi Kawamura; Tetsuo Tsuchiya; Fumio Goto; Hideaki Tsuyuki, all of Tokyo; Kazuhiro Miyajima, Aichi; Takashi Matsuda, Aichi; Nobuhiko Okano, Aichi; Hirofumi Mochizuki, Aichi, all of Japan

[73] Assignees: Showa Shell Seikyu K.K., Tokyo; Toyota Jidosha Kabushiki Kaisha, Toyota, both of Japan

[21] Appl. No.: 249,033

[22] Filed: May 25, 1994

[30] Foreign Application Priority Data

May 25, 1993 [JP] Japan ..... 5-145672

[51] Int. Cl.[6] ..... C10M 115/08; C10M 135/18

[52] U.S. Cl. ..... 252/42.7; 252/46.6; 252/51.5 R

[58] Field of Search ..... 252/46.6, 42.7

[56] References Cited

U.S. PATENT DOCUMENTS

| | | | |
|---|---|---|---|
| 3,480,700 | 11/1969 | Mettsner | 252/46.6 |
| 3,483,122 | 12/1969 | MacPhail et al. | 252/46.6 |
| 4,514,312 | 4/1985 | Root et al. | 252/32.5 |
| 4,832,767 | 5/1989 | Seiki et al. | 252/46.6 |
| 4,840,740 | 6/1989 | Sato et al. | 252/32.7 E |
| 5,160,645 | 11/1992 | Okaniwa et al. | 252/46.6 |
| 5,207,936 | 5/1993 | Anzai et al. | 252/46.6 |

FOREIGN PATENT DOCUMENTS

| | | |
|---|---|---|
| 2676065 | 11/1992 | France . |
| 3244693 | 10/1991 | Japan . |
| 434590 | 6/1992 | Japan . |

OTHER PUBLICATIONS

Database EPI, Week 9010, Derwent Publications, Ltd., AN 90-069665[10] (JP-A-2020597).

Patent Abstracts Of Japan, vol. 016, No. 033 (C-0905), Jan. 28, 1992 (JP-A-03244693).

Patent Abstracts Of Japan, vol. 012, No. 070 (C-479), Mar. 4, 1988 (JP-A-62207397).

*Primary Examiner*—Ellen M. McAvoy

*Attorney, Agent, or Firm*—Sughrue, Mion, Zinn, Macpeak & Seas

[57] ABSTRACT

A urea grease composition is disclosed, which comprises a urea grease and, incorporated therein as additives, a sulfurized molybdenum dialkyldithiocarbamate represented by formula (A):

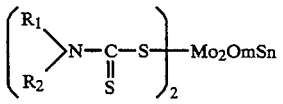

wherein $R_1$ and $R_2$ each independently represent an alkyl group having from 1 to 24 carbon atoms, m+n=4, m is 0 to 3, and n is 4 to 1 and triphenyl phosphorothionate represented by formula (B):

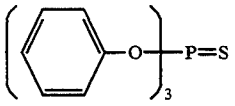

3 Claims, No Drawings

UREA GREASE COMPOSTITION

FIELD OF THE INVENTION

The present invention relates to a urea grease composition suitable for application to such parts to be grease-lubricated as CV joints (Constant Velocity Universal joints) and ball joints in motor vehicles and bearings and gears of machinery in the steel and other various industries.

BACKGROUND OF THE INVENTION

With the recent progress in machine technology, there are growing desires for size reduction, weight reduction, precision increase, life prolongation, etc. in machines. Since the joints, bearings, gears, and other components of rotating parts also are small-sized and operated under high-speed and high load conditions, the atmospheres in which the lubricating greases applied to such parts are used have been becoming very severe.

CVJs (CV joints) and steel-rolling machines are taken as examples to explain the above in more detail.

In the automobile industry, the number of vehicles employing a CVJ has increased with the increase in the number of FF (front engine front drive) automobiles. Not only FF vehicles but also four wheel drive (4 WD) vehicles are increasing in number recently, with which the amount of CVJs for automotive use increased rapidly. In particular, because of the trends toward power and performance increase in FF vehicles and toward size reduction and weight reduction in CVJs and because operating condition of CVJs are becoming more severe, the durability requirement for CVJs is becoming more and more severe. For example, CVJs have come to be disposed at increased angles and be operated at higher speeds under higher loads due to the employment of turbo-equipped or larger-sized engines and, hence, there are cases where the temperature of CVJs rises rapidly during driving because of, e.g., increased internal heat generation. Various kinds of CVJs exist, which are properly used according to applications. Since the lubricants to be applied to CVJs are also required to cope with torque and speed increase, there is a desire for a grease which not only has excellent resistance to higher temperatures but also is excellent in so-called heating-inhibitory effect, i.e., the effect of diminishing the friction of sliding parts to minimize temperature increase.

The inhibition of temperature increase by the diminution of friction is desired also from the standpoints of improving the durability of joints and sealing boot materials and retarding the deterioration of the lubricant itself. An excessive temperature increase accelerates the aging of the sealing boot material and the deterioration of the lubricant, resulting in a significantly shortened CVJ life.

In the steel industry, on the other hand, there has been a strong desire for greases with higher qualities such as longer life and higher heat resistance because of the necessity for energy saving, labor saving, resource saving, and prevention of environmental pollution. A steel factory contains various kinds of machinery, and greases to be used therein slightly differ in required performance depending on the atmospheric conditions. In the steel rolling step, in which most of the greases are consumed, the bearings, sliding surfaces, screws, and other parts of the rolling machine are greased by means of central lubrication, and the greases for this use mostly contain an extreme pressure additive. Since such mechanical parts in the steelmaking equipment are considerably affected by load and heat and are operated in an environment containing water and scales, a grease excellent especially in wear resistance, frictional property, and sealing property is desired for the elongation of the lives of these mechanical parts.

In order to cope with the above-described desires, extreme pressure lithium greases are mainly used in the market. These greases contain a sulfur-phosphorus extreme pressure additive comprising a combination of a sulfurized oil, fat, or olefin and zinc dithiophosphate, a lead compound additive, and molybdenum disulfide. Further, urea greases having better heat resistance than the lithium greases are recently being used increasingly.

Under these circumstances, representative prior art techniques include U.S. Pat. Nos. 4,840,740 and 4,514,312 and JP-B-4-34590. (The term "JP-B" as used herein means an "examined Japanese patent publication.") U.S. Pat. No. 4,840,740 discloses a urea grease containing as an additive a combination of an organomolybdenum compound and zinc dithiophosphateo. U.S. Pat. No. 4,514,312 discloses a urea grease containing an aromatic amine phosphate. Further, JP-B-4-34590 discloses a urea grease containing as an essential ingredient a sulfur-phosphorus extreme pressure additive comprising a combination of (A) a sulfurized molybdenum dialkyldithiocarbamate and (B) at least one selected from the group consisting of sulfurized oils or fats, sulfurized olefins, tricresyl phosphate, trialkyl thiophosphates, and zinc dialkyldithiophosphates.

However, the greases according to these prior art techniques have a problem that they deteriorate sealing materials. That is, the sealing boot materials, which mostly are chloroprene rubbers, silicone rubbers, and polyester resins, are deteriorated by the conventional greases at high temperatures. For example, greases containing such additives as a sulfurized oil or fat and a sulfurized olefin deteriorate chloroprene rubber to cause considerable changes in tensile strength and elongation. Greases containing a zinc dialkyldithiophosphate deteriorate silicone rubbers, while greases containing lead naphthenate accelerate the deterioration of silicone rubbers and polyester resins to greatly affect the properties thereof.

SUMMARY OF THE INVENTION

The first object of the present invention is to provide a urea grease which is effective in friction diminution to have excellent heating-inhibiting property and to attain excellent wear resistance and which further has good heat resistance.

The second object of the present invention is to provide a urea grease composition which never deteriorates sealing materials.

The present invention provides a urea grease composition comprising a urea grease and, incorporated therein as additives, a sulfurized molybdenum dialkyldithiocarbamate represented by formula (A):

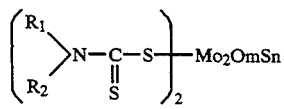

(wherein $R_1$ and $R_2$ each independently represent an alkyl group having from 1 to 24 carbon atoms, m+n=4, m is 0 to 3, and n is 4 to 1) and triphenyl phosphorothionate represented by formula (B):

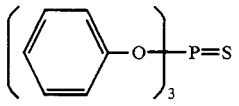

DETAILED DESCRIPTION OF THE INVENTION

Examples of the sulfurized molybdenum dialkyldithiocarbamate (A) include sulfurized molybdenum diethyldithiocarbamate, sulfurized molybdenum dibutyldithiocarbamate, sulfurized molybdenum diisobutyldithiocarbamate, sulfurized molybdenum di(2-ethylhexyl)dithiocarbamate, sulfurized molybdenum diamyldithiocarbamate, sulfurized molybdenum diisoamyldithiocarbamate, sulfurized molybdenum dilauryldithiocarbamate, sulfurized molybdenum distearyldithiocarbamate, sulfurized molybdenum n-butyl-2-ethylhexyldithiocarbamate, and sulfurized molybdenum 2-ethylhexylstearyldithiocarbamate. The amount of compound (A) to be added is from 0.5 to 10% by weight, preferably from 0.5 to 5% by weight, based on the amount of the whole grease composition. If the amount thereof is below 0.5% by weight, the additive is ineffective in improving wear resistance and frictional properties. Even if the amount thereof exceeds 10% by weight, its effects cannot be heightened any more.

The triphenyl phosphorothionate (B) is used in an amount of from 0.1 to 10% by weight, preferably from 0.1 to 5% by weight, based on the amount of the whole grease composition. If the amount thereof is below 0.1% by weight, no improvement is attained in wearing and frictional properties. If the amount thereof is above 10% by weight, sufficient lubricating performance cannot be exhibited.

As the urea compound to be used as a thickener, any of the known urea thickeners can be employed without any particular limitation on their kind. Examples thereof include diurea, triurea, and tetraurea.

As the base oil is used a mineral oil and/or a synthetic oil. The urea compound is used in an amount of from 2 to 35% by weight based on the total amount of the base oil and the urea compound.

An antioxidant, rust inhibitor, extreme pressure additive, polymeric additive, and other ingredients can be added to the composition of the present invention.

The present invention will be explained below in more detail by reference to the following Examples and Comparative Examples, but the invention is not construed as being limited thereto.

EXAMPLES AND COMPARATIVE EXAMPLES

Additives were added to base greases according to the formulations shown in Tables 1 to 2 and the resulting mixtures each was treated with a three-roll mill to obtain greases of Examples and Comparative Examples. The base greases had the compositions specified below. As the base oil was used a purified mineral oil having a viscosity at 100° C. of 15 $mm^2$/sec.

I. Diurea Grease

One mol of diphenylmethane-4,4'-diisocyanate was reacted with 1 mol of p-toluidine and 1 mol of furfurylamine in a base oil, and the urea compound yielded was homogeneously dispersed to obtain a grease. The urea compound content was regulated at 15% by weight.

II. Tetraurea Grease

Two mol of diphenylmethane-4,4'-diisocyanate was reacted with 2 mol of octylamine and 1 mol of ethylenediamine in a base oil, and the urea compound yielded was homogeneously dispersed to obtain a grease. The urea compound content was regulated at 15% by weight.

III. Lithium Grease

Lithium 12-hydroxystearate was dissolved in a base oil and homogeneously dispersed to obtain a grease. The soap content was regulated at 9% by weight.

IV. Aluminum-complex Grease

In a base oil were dissolved benzoic acid and stearic acid. A commercially available cyclic aluminum oxide isopropylate lubricant (trade name, Algomer; manufactured by Kawaken Fine Chemicals Co., Ltd., Japan) was then added thereto and reacted, and the soap yielded was homogeneously dispersed to obtain a grease. The soap content was regulated at 11% by weight. The proportion of the benzoic acid (BA) to the stearic acid (FA) was such that BA/FA=1.1 by mol, while the proportion of the sum of the benzoic acid and stearic acid to the aluminum (Al) was such that (BA+FA)/Al=1.9 by mol.

The greases were evaluated for the properties specified in the Tables, i.e., friction coefficient, wear resistance, heating-inhibiting property, suitability for use with sealing materials, and heat resistance, by examining these properties by the following tests.

(1) Friction Coefficient

A Falex tester was used to determine the friction coefficient after a 15-minute run under the following conditions (in accordance with IP241/69).

Rotational speed: 290 rpm
Load: 200 lb
Temperature: room temp.
Time: 15 min
Grease: about 1 g of grease was applied on test piece (2) Wear Resistance Wear resistance was determined by a 4-ball wear test in accordance with ASTM D2226.

Rotational speed: 1,200 rpm
Load: 40 kgf
Temperature: 75° C.
Time: 60 min (3) Heating-inhibiting Property Temperature Measurement The frictional part of a CVJ was greased with each sample and sealed. The CVJ was operated under the following conditions, and the temperature of the surface of the outer race was then measured.

CVJ type: Tripod (Universal) joint
Rotational speed: 2,000 rpm
Joint angle: 10 degree
Torque: 30 kgf-m
Time: 2 hrs (4) Suitability for Use with Sealing Materials In accordance with the physical test of vulcanized rubbers as provided for in JIS K6301, chloroprene rubber, a silicone rubber, and a polyester resin as sealing materials were immersed in each grease composition under the following conditions. The elongation and tensile strength of each material were measured before and after the immersion test and the degree of change of each property was determined.

Temperature: 140° C.
Immersion Time: 72 hrs (5) Heat Resistance

Heat resistance was determined by a dropping point test in accordance with JIS K2220.

TABLE 1

| Example | 1 | 2 | 3 | 4 | 5 | 6 | 7 | 8 | 9 |
|---|---|---|---|---|---|---|---|---|---|
| Composition wt % | | | | | | | | | |
| Base grease | | | | | | | | | |
| Diurea grease | 96.5 | | 95.0 | | | 93.0 | | 96.0 | 94.5 |
| Tetraurea grease | | 96.5 | | 96.0 | 94.0 | | 96.5 | | |
| Additive | | | | | | | | | |
| A-1 *1 | 3.0 | 3.0 | 3.0 | 2.0 | 5.0 | 2.0 | | 1.0 | |
| A-2 *2 | | | | 1.0 | | 3.0 | 3.0 | 2.0 | 5.0 |
| B *3 | 0.5 | 0.5 | 2.0 | 1.0 | 1.0 | 2.0 | 0.5 | 1.0 | 0.5 |
| Total | 100.0 | 100.0 | 100.0 | 100.0 | 100.0 | 100.0 | 100.0 | 100.0 | 100.0 |
| Test Results | | | | | | | | | |
| Friction coefficient (μ) | 0.085 | 0.082 | 0.075 | 0.080 | 0.081 | 0.074 | 0.082 | 0.079 | 0.080 |
| Wear resistance (mm) | 0.39 | 0.39 | 0.36 | 0.37 | 0.37 | 0.35 | 0.39 | 0.37 | 0.38 |
| Heating-inhibiting property (°C.) | 151 | 145 | 142 | 145 | 146 | 144 | 150 | 148 | 147 |
| Degree of elongation change for chloroprene rubber, % | −21.2 | −22.0 | −23.1 | −20.8 | −21.6 | −23.2 | −20.5 | −21.7 | −23.1 |
| Degree of tensile strength change for chloroprene rubber, % | +1.7 | +1.1 | −3.0 | +1.2 | +2.5 | −4.0 | −2.3 | −1.1 | +3.8 |
| Degree of elongation change for silicone rubber, % | −8.1 | −8.5 | −10.0 | −12.0 | −10.5 | −14.9 | −8.5 | −11.3 | −10.1 |
| Degree of tensile strength change for silicone rubber, % | −6.6 | −7.8 | −10.1 | −7.6 | −7.9 | −8.3 | −7.9 | −8.8 | −9.1 |
| Degree of elongation change for polyester resin, % | +4.0 | +3.9 | +4.1 | +3.8 | +3.7 | +4.9 | +4.0 | +4.0 | +4.8 |
| Degree of tensile strength change for polyester resin, % | −20.2 | −19.6 | −21.1 | −18.3 | −19.1 | −20.1 | −19.5 | −18.7 | −18.9 |
| Heat resistance (dropping point, °C.) | >250 | 243 | >250 | 245 | 243 | >250 | 243 | >250 | >250 |

*1: A-1 is a sulfurized molybdenum dialkyldithiocarbamate in which the alkyls are $C_4$ and n = 2.3.
*2: A-2 is a sulfurized molybdenum dialkyldithiocarbamate in which the alkyls are $C_4$ and n = 4.
*3: B is a triphenyl phosphorothionate.

TABLE 2

| Comparative Example | 1 | 2 | 3 | 4 | 5 | 6 | 7 | 8 | 9 | 10 |
|---|---|---|---|---|---|---|---|---|---|---|
| Composition wt % | | | | | | | | | | |
| Base grease | | | | | | | | | | |
| Diurea grease | 97.0 | 98.0 | | | 95.0 | 95.0 | 96.5 | | | |
| Tetraurea grease | | | 98.0 | | | | | | 95.0 | 95.0 |
| Lithium grease | | | | 95.0 | | | | | | |
| Aluminum-complex | | | | | 95.0 | | | | | |
| Additive | | | | | | | | | | |
| A-1 *1 | 3.0 | | | 3.0 | 3.0 | 3.0 | 3.0 | 3.0 | | |
| A-2 *2 | | | | | | | | | 3.0 | 3.0 |
| Zinc dialkyldithio-phosphate | | | | | | | 2.0 | | | |
| Sulfurized olefin | | | | | | | | 0.5 | | |
| Sulfurized oil or fat | | | | | | | | | 2.0 | |
| Lead naphthenate | | | | | | | | | 2.0 | |
| Tricrecyl phosphate | | | | | | 2.0 | | | | |
| B *3 | | 2.0 | 2.0 | 2.0 | 2.0 | | | | | |
| Total | 100.0 | 100.0 | 100.0 | 100.0 | 100.0 | 100.0 | 100.0 | 100.0 | 100.0 | 100.0 |
| Test Results | | | | | | | | | | |
| Friction coefficient (μ) | 0.111 | 0.134 | 0.135 | 0.113 | 0.112 | 0.111 | 0.095 | — | 0.110 | — |
| Wear resistance (mm) | 0.44 | 0.48 | 0.47 | 0.44 | 0.44 | 0.42 | — | 0.44 | — | |

TABLE 2-continued

| Comparative Example | 1 | 2 | 3 | 4 | 5 | 6 | 7 | 8 | 9 | 10 |
|---|---|---|---|---|---|---|---|---|---|---|
| Heating-inhibiting property (°C.) | 164 | 173 | 179 | 167 | 165 | 165 | 157 | — | — | — |
| Degree of elongation change for chloroprene rubber, % | −21.0 | — | — | — | — | — | — | −76.4 | −64.7 | — |
| Degree of tensile strength change for chloroprene rubber, % | +1.3 | — | — | — | — | — | — | −64.4 | −50.8 | — |
| Degree of elongation change for silicone rubber, % | −8.0 | — | — | — | — | — | −79.8 | — | — | −70.9 |
| Degree of tensile strength change for silicone rubber, % | −6.8 | — | — | — | — | — | −74.1 | — | — | −66.6 |
| Degree of elongation change for polyester resin, % | +3.8 | — | — | — | — | — | — | — | — | −35.1 |
| Degree of tensile strength change for polyester resin, % | −19.7 | — | — | — | — | — | — | — | — | −41.7 |
| Heat resistance (dropping point, °C.) | >250 | >250 | 244 | 195 | >250 | >250 | >250 | 243 | >250 | >250 |

*1, *2, *3 are the same as those in Table 1.

Evaluation

The data for Comparative Examples 1 to 6 on friction coefficient, wear resistance, and heating-inhibiting property are all inferior to those for Examples 1 to 9. The data for Comparative Example 7 are better than those for Comparative Examples 1 to 6, but the grease of Comparative Example 7 has extremely poor suitability for use with the silicone rubber. The greases of Comparative Examples 8 and 9 have poor suitability for use with the chloroprene rubber. The grease of Comparative Example 10 has poor suitability for use with both silicone rubber and polyester resin.

In contrast, the results clearly show that the greases of Examples 1 to 9 are all excellent in friction coefficient, wear resistance, and heating-inhibiting property and in suitability for use with any of the sealing materials.

The present invention produces the following effects.

(1) The grease of the invention attains excellent wear resistance and, due to its friction-diminishing effect, it shows useful so-called heating-inhibiting properties, i.e., the property of inhibiting the heating of the greased frictional part. As a result, an improvement of the durability of joints and bearings and the prevention of lubricant deterioration can be attained.

(2) The grease of the invention has excellent suitability for use with chloroprene rubber, silicone rubbers, and polyester resins to retard the deterioration of the sealing materials in sealed devices even at elevated temperatures.

(3) The grease of the invention has an extremely high dropping point and excellent heat resistance.

While the invention has been described in detail and with reference to specific embodiments thereof, it will be apparent to one skilled in the art that various changes and modifications can be made therein without departing from the spirit and scope thereof.

What is claimed is:

1. A urea grease composition comprising a urea grease and, incorporated therein as additives, a sulfurized molybdenum dialkyldithiocarbamate represented by formula (A):

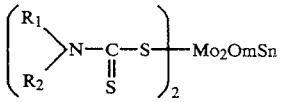

wherein $R_1$ and $R_2$ each independently represent an alkyl group having from 1 to 24 carbon atoms, m+n=4, m is 0 to 3, and n is 4 to 1 and triphenyl phosphorothionate represented by formula (B):

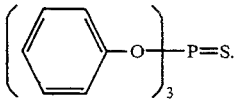

2. A urea grease composition as claimed in claim 1, wherein the amount of compound (A) is from 0.5 to 10% by weight and the amount of compound (B) is from 0.1 to 10% by weight based on the amount of the whole composition.

3. A urea grease composition as claimed in claim 1 or 2, which contains a urea compound as a thickener in an amount of from 2 to 35% by weight based on the total amount of the base oil and the urea compound.

* * * * *